US006593918B2

(12) United States Patent
Taguchi et al.

(10) Patent No.: US 6,593,918 B2
(45) **Date of Patent: *Jul. 15, 2003**

(54) MATRIX-TYPE PANEL DRIVING CIRCUIT AND METHOD AND LIQUID CRYSTAL DISPLAY DEVICE

(75) Inventors: Yoshihisa Taguchi, Kawasaki (JP); Katsunori Tanaka, Kawasaki (JP); Toshiya Onodera, Kawasaki (JP); Katsuhiko Kishida, Kawasaki (JP); Hirofumi Miyamoto, Kawasaki (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/093,446

(22) Filed: Jun. 8, 1998

(65) Prior Publication Data

US 2001/0043201 A1 Nov. 22, 2001

(30) Foreign Application Priority Data

Oct. 20, 1997 (JP) ..... 9-287339

(51) Int. Cl.[7] ..... G09G 5/00

(52) U.S. Cl. ..... 345/204; 345/99

(58) Field of Search ..... 345/204, 96, 97, 345/98, 87, 88, 99

(56) References Cited

U.S. PATENT DOCUMENTS

| | | | | |
|---|---|---|---|---|
| 5,754,155 A | * | 5/1998 | Kubota et al. | 345/98 |
| 5,990,857 A | * | 11/1999 | Kubota et al. | 345/98 |
| 6,023,258 A | * | 2/2000 | Kuriyama et al. | 345/60 |

FOREIGN PATENT DOCUMENTS

| | | |
|---|---|---|
| JP | 6-149181 | 5/1994 |
| JP | 8-179721 | 7/1996 |
| JP | 9-44118 | 2/1997 |

* cited by examiner

*Primary Examiner*—Richard Hjerpe
*Assistant Examiner*—Ronald Laneau
(74) *Attorney, Agent, or Firm*—Greer, Burns & Crain, Ltd.

(57) ABSTRACT

A driving circuit for a matrix-type panel includes a control circuit which causes image data to be supplied to the matrix-type panel when a synchronization between the image data and an operation of the matrix-type panel is established after a supply of a given timing signal necessary for an operation of the control circuit is stopped and is then restarted.

9 Claims, 17 Drawing Sheets

MATRIX-TYPE PANEL DRIVING CIRCUIT AND METHOD AND LIQUID CRYSTAL DISPLAY DEVICE

BACKGROUND OF THE INVENTION

1. Field of the Invention

The present invention relates to driving of a matrix type panel and more particularly to driving of a matrix type panel using a liquid crystal.

A matrix-type panel has display elements (pixels) arranged in a matrix formation. Data is written into the panel while the horizontal lines of the panel are sequentially selected one by one. The data is applied to the selected horizontal line on which a line image defined by the applied data is formed. Generally, such a matrix-type panel employs a liquid crystal. For example, a type of matrix-type liquid crystal panel has switching elements which are formed to thin film transistors (TFT) located at the pixels arranged in the matrix formation. Another type of matrix-type liquid crystal panel has a matrix electrode structure called CS-ON-GATE.

2. Description of the Related Art

FIG. 1 is a block diagram of a liquid crystal display device using a matrix-type liquid crystal display panel as described above. The device shown in FIG. 1 includes a panel 10, a data driver 12, a gate driver 14 and a timing control circuit 16. The panel 10 has display elements arranged in a matrix formation. The data driver 12 receives data R (red), G (green) and B (blue) (hereinafter also referred to as RGB data) to be written into a horizontal line, and outputs the received RGB data to the panel 10. The gate driver 14 selects the horizontal line on the panel 10. The timing control circuit 16 provides the data driver 12 and the gate driver 14 with given timing signals (which will be described later). The RGB data, which is gradation data, can be analog image data or digital image data. The analog image data is ac data which drives the liquid crystal in an ac formation. The digital data is gradation data consisting of a plurality of bits, and conversion of ac data is carried out within the data driver 12.

FIG. 2 is a block diagram of an internal structure of the gate driver 14, which is made up of an inverter 18, an n-stage shift register 20 and AND gates $\mathbf{22}_1$ through $\mathbf{22}_n$ where n is an integer. The gate driver 14 receives timing signals Φx, STV and /OEG. The timing signal Φx is a shift clock signal, and the timing signal STV is a start pulse signal which starts the gate driver 14 operating. The timing signal /OEG is an output enable signal which enables the gate driver 14. The shift register 20 latches the start signal STV when the shift clock Φx rises while the start pulse signal STV is high, and outputs a high-level signal to the AND gate $\mathbf{22}_1$. The AND gate $\mathbf{22}_1$ is connected to, for example, the first line of the panel 10, and outputs a high-level signal when the output enable signal /OEG is low. The output signal of the AND gate $\mathbf{22}_1$ is applied to the panel 10 as a driving signal, and the first line of the panel 10 is selected. As described above, the shift operation is carried out each time the shift clock Φx rises, and the panel 10 is sequentially selected one line by one line.

FIG. 3 is a block diagram of an internal structure of the data driver 12 shown in FIG. 1. The data driver 12 includes an m-stage shift register 24, switches $\mathbf{26}_1$–$\mathbf{26}_m$, and data latches $\mathbf{28}_1$–$\mathbf{28}_m$ where m is an integer and may be equal to or not equal to n. The switch $\mathbf{26}_m$ and the data latch $\mathbf{28}_m$ are not shown in FIG. 3. The data driver 12 receives timing signals SIO, CLK and LE generated by the timing control circuit 16. The timing signal SIO is a start pulse signal which starts the data driver 12 operating. The timing signal CLK is a clock signal. The timing signal LE is a latch control signal. The shift register 24 latches the start pulse signal SIO when the clock signal CLK rises while the start pulse signal SIO is high, and shifts the start pulse signal SIO each time the clock signal CLK rises. Hence, the switches $\mathbf{26}_1$, $\mathbf{26}_2$ and $\mathbf{26}_3$ are sequentially selected and data R, G and B externally supplied are latched. Hence, data equal to one horizontal line is latched, and thereafter the latch control signal LE is switched to the high level. Hence, the data equal to one horizontal line is output to the panel 10 at one time.

The timing control circuit 16 produces the above-mentioned timing signals from a vertical synchronizing signal V-SYNC and a horizontal synchronizing signal H-SYNC.

A "free run" occurs in the matrix-type panel display device. The free run indicates a state in which a timing signal to be applied is not applied temporarily. More particularly, inputting of at least one of the vertical synchronizing signal V-SYNC and the horizontal synchronizing signal H-SYNC is temporarily stopped.

FIG. 4 is a timing chart showing operations of the structures shown in FIGS. 1 through 3. In FIG. 4, the first pulse P1 of the vertical synchronizing signal V-SYNC, and then the horizontal synchronizing signal H-SYNC is input. Thereafter, a state is encountered in which both the vertical synchronizing signal V-SYNC and the horizontal synchronizing signal H-SYNC are stopped. Such a state is the free run. The timing control circuit 16, which produces the timing signals from the vertical and horizontal synchronizing signals V-SYNC and H-SYNC, is designed to continue to produce the timing signals STV, Φx and /OEG even if the synchronizing signals are stopped. Hence, a dc component is prevented from flowing in the panel 10. For instance, if the liquid crystal display device displays an image reproduced by a video tape player or recorder, the RGB data is applied from the video tape player. In this case, if the reproduction of the video tape player is paused, the free-run state takes place and the vertical synchronizing signal V-SYNC and the horizontal synchronizing signal H-SYNC are stopped. However, writing of data can be enabled because the timing control circuit 16 continues to produce the timing signals.

Thereafter, a pulse P2 of the vertical synchronizing signal V-SYNC is input and the horizontal synchronizing signal H-SYNC is input. Pulse #1 of the start pulse signal STV is produced in response to the pulse P1 of the vertical synchronizing signal V-SYNC by the timing generating circuit 16. Similarly, pulse #2 of the start pulse signal STV is produced in response to the pulse P2. In response to pulse #1, the horizontal lines are sequentially scanned one by one in synchronism with the shift clock Φx. Pulse #2 is produced when a certain horizontal line is being scanned. In this case, the scanning of the first horizontal line is started in response to pulse #2 of the start pulse signal STV. That is, two horizontal lines respectively responsive to pulses #1 and #2 are concurrently scanned. Hence, an image which is to be displayed on an upper portion of the plane is displayed on an intermediate portion of the plane starting from a horizontal line which is currently driven in response to pulse #1.

The free run causes a problem when a wide display is realized on the panel 10. FIG. 5 shows a case where a wide display having an aspect ratio of 16:9 is realized on the panel 10 of a normal size having an aspect ratio of 4:3. In this case, black is displayed on upper and lower display portions (dotted areas) of the panel 10, and the wide display is realized on the remaining display area having an aspect ratio of 16:9. When the free run occurs, the timing control circuit 16 is not provided with the vertical synchronizing signal V-SYNC and the horizontal synchronizing signal H-SYNC. Hence, the timing control circuit 16 cannot recognize which portion of the panel 10 is being scanned. If the supply of the vertical synchronizing signal V-SYNC and the horizontal synchronizing signal H-SYNC is restarted, an image may instantaneously displayed on the black areas. Such an instantaneous display may be distractive to the person who watches the panel 10.

SUMMARY OF THE INVENTION

It is a general object of the present invention to provide a matrix-type panel driving circuit and method and a liquid crystal display device in which the above disadvantages are eliminated.

A more specific object of the present invention is to provide a matrix-type panel driving circuit and method and a liquid crystal display device in which a disturbance of image on the panel is suppressed.

The above objects of the present invention are achieved by a driving circuit for a matrix-type panel comprising a control circuit which causes image data to be supplied to the matrix-type panel when a synchronization between the image data and an operation of the matrix-type panel is established after a supply of a given timing signal necessary for an operation of the control circuit is stopped and is then restarted.

The above driving circuit may be configured so that the control circuit comprises: a data driver which latches image data equal to one horizontal line of the matrix-type panel and outputs the image data thereto; a gate driver which sequentially selects one of horizontal lines of the matrix-type panel in order to write the image data to a selected horizontal line; and a circuit which causes an output of the gate driver to be in a disabled state during a given period after the supply of the given timing signal is stopped and is then restarted.

The driving circuit may be configured so that it further comprises a circuit which varies the given period.

The driving circuit may be configured so that the control circuit comprises: a data driver which latches image data equal to one horizontal line of the matrix-type panel and outputs the image data thereto; a gate driver which sequentially selects one of horizontal lines of the matrix-type panel in order to write the image data to a selected horizontal line; and a circuit which supplies a given value to the data driver instead of the image data during a given period after the supply of the given timing signal is stopped and is then restarted.

The above objects of the present invention are achieved by a driving method for a matrix-type panel comprising the step of causing image data to be supplied to the matrix-type panel when a synchronization between the image data and an operation of the matrix-type panel is established after a supply of a given timing signal necessary for an operation of the control circuit is stopped and is then restarted.

The above driving method may further comprise the steps of: latching image data equal to one horizontal line of the matrix-type panel and outputting the image data thereto; sequentially selecting one of horizontal lines of the matrix-type panel in order to write the image data to a selected horizontal line; and causing the outputting of the image data to be in a disabled state during a given period after the supply of the given timing signal is stopped and is then restarted.

The driving method may be configured so that it further comprises the steps of: latching image data equal to one horizontal line of the matrix-type panel and outputting the image data thereto; sequentially selecting one of horizontal lines of the matrix-type panel in order to write the image data to a selected horizontal line; and supplying a given value to the matrix-type panel instead of the image data during a given period after the supply of the given timing signal is stopped and is then restarted.

The above objects of the present invention are also achieved by a matrix-type display device comprising: a matrix-type panel; and a driving circuit driving the matrix-type panel, the driving circuit comprising a control circuit which causes image data to be supplied to the matrix-type panel when a synchronization between the image data and an operation of the matrix-type panel is established after a supply of a given timing signal necessary for an operation of the control circuit is stopped and is then restarted.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Figure 1:
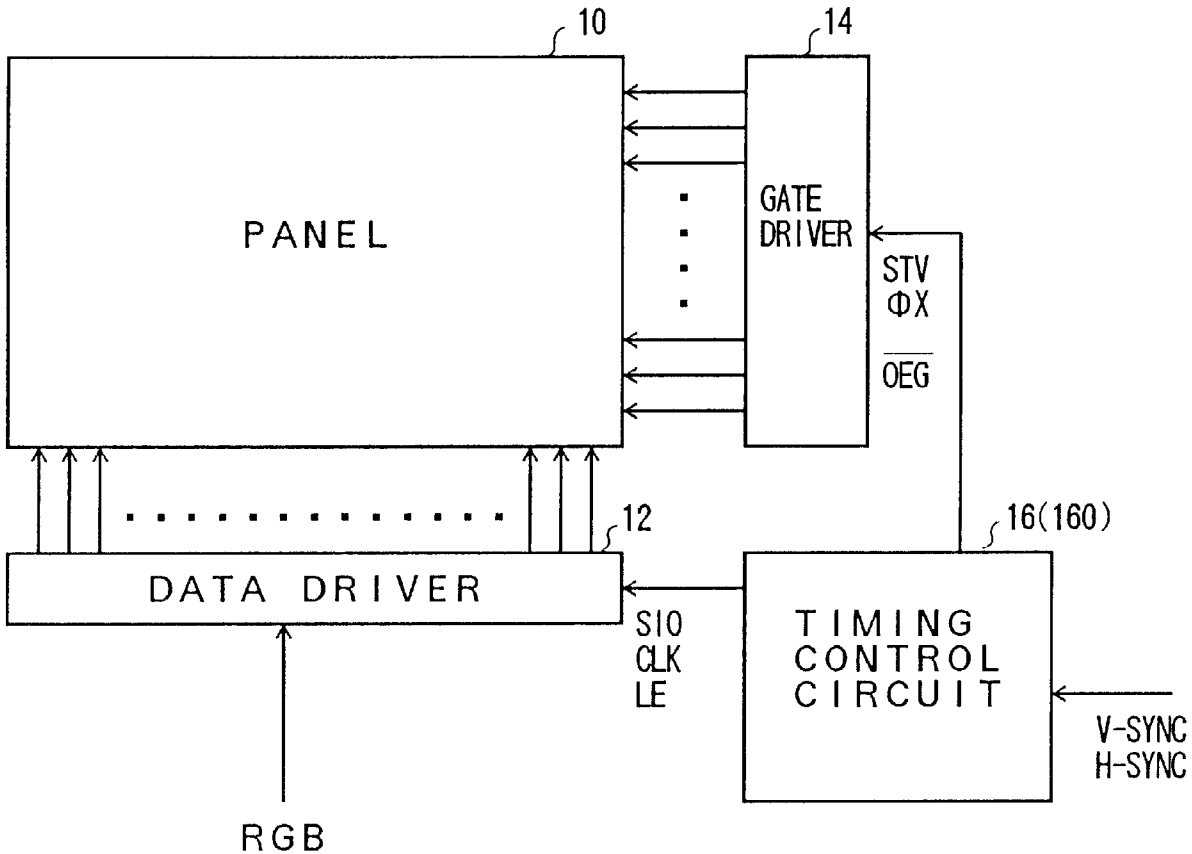
FIG. 1 PRIOR ART
FIG. 1 is a block diagram of a known liquid crystal display device.
Figure 2:
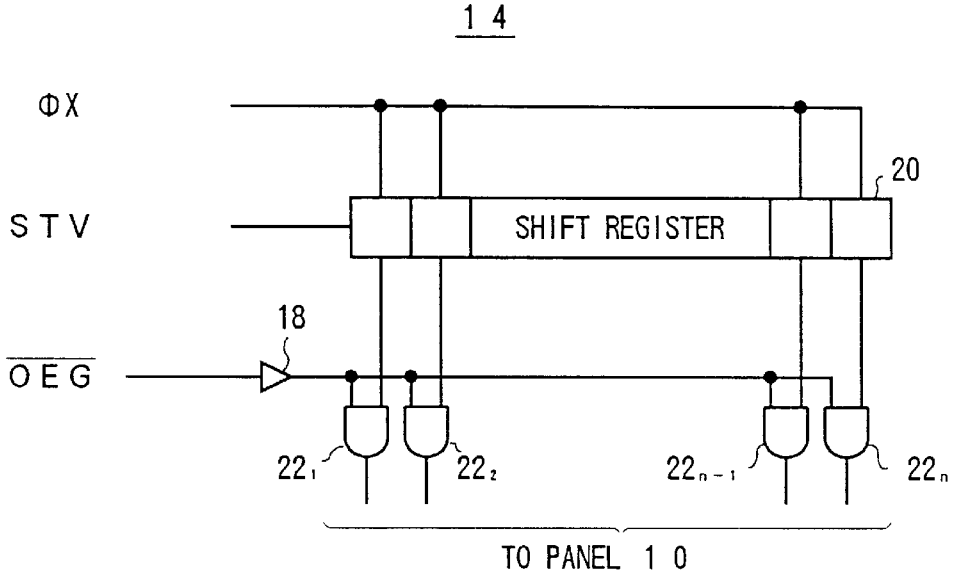
FIG. 2 PRIOR ART
FIG. 2 is a block diagram of a structure of a gate driver shown in FIG. 1.
Figure 3:
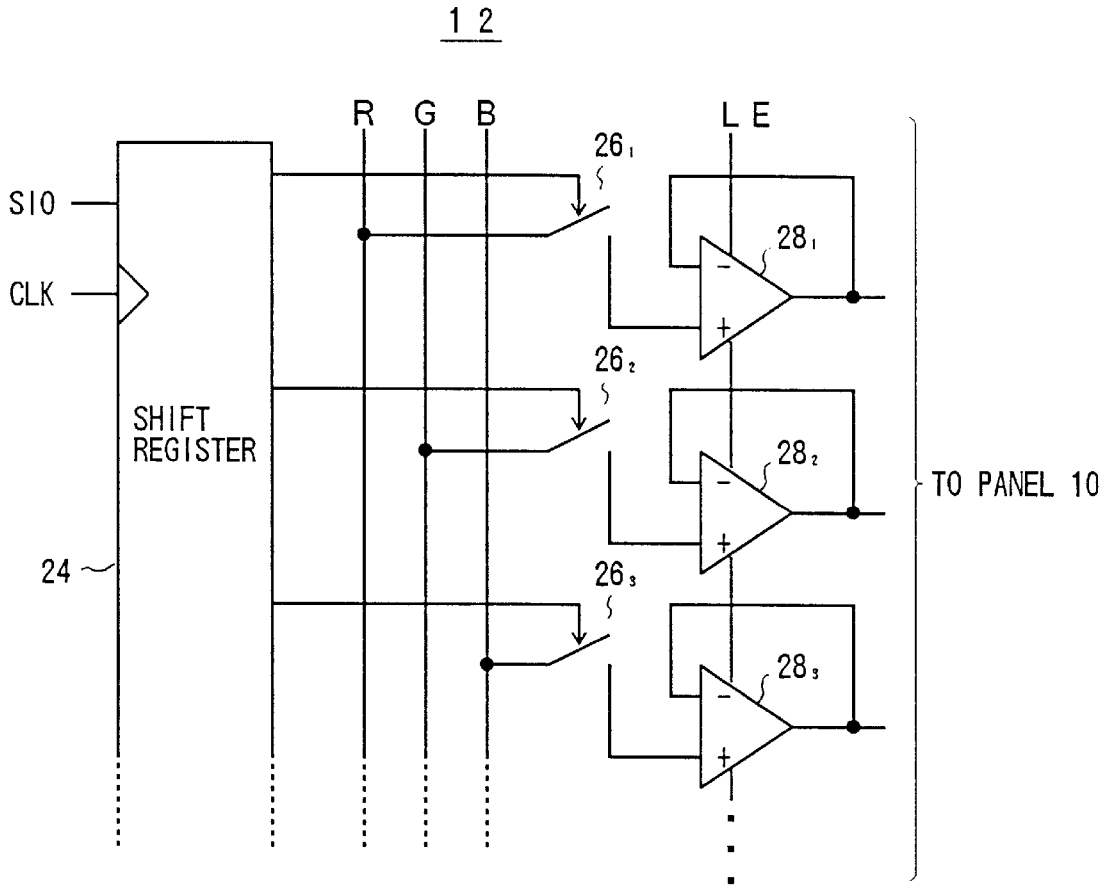
FIG. 3 PRIOR ART
FIG. 3 is a block diagram of a structure of a data driver shown in FIG. 1.
Figure 6:
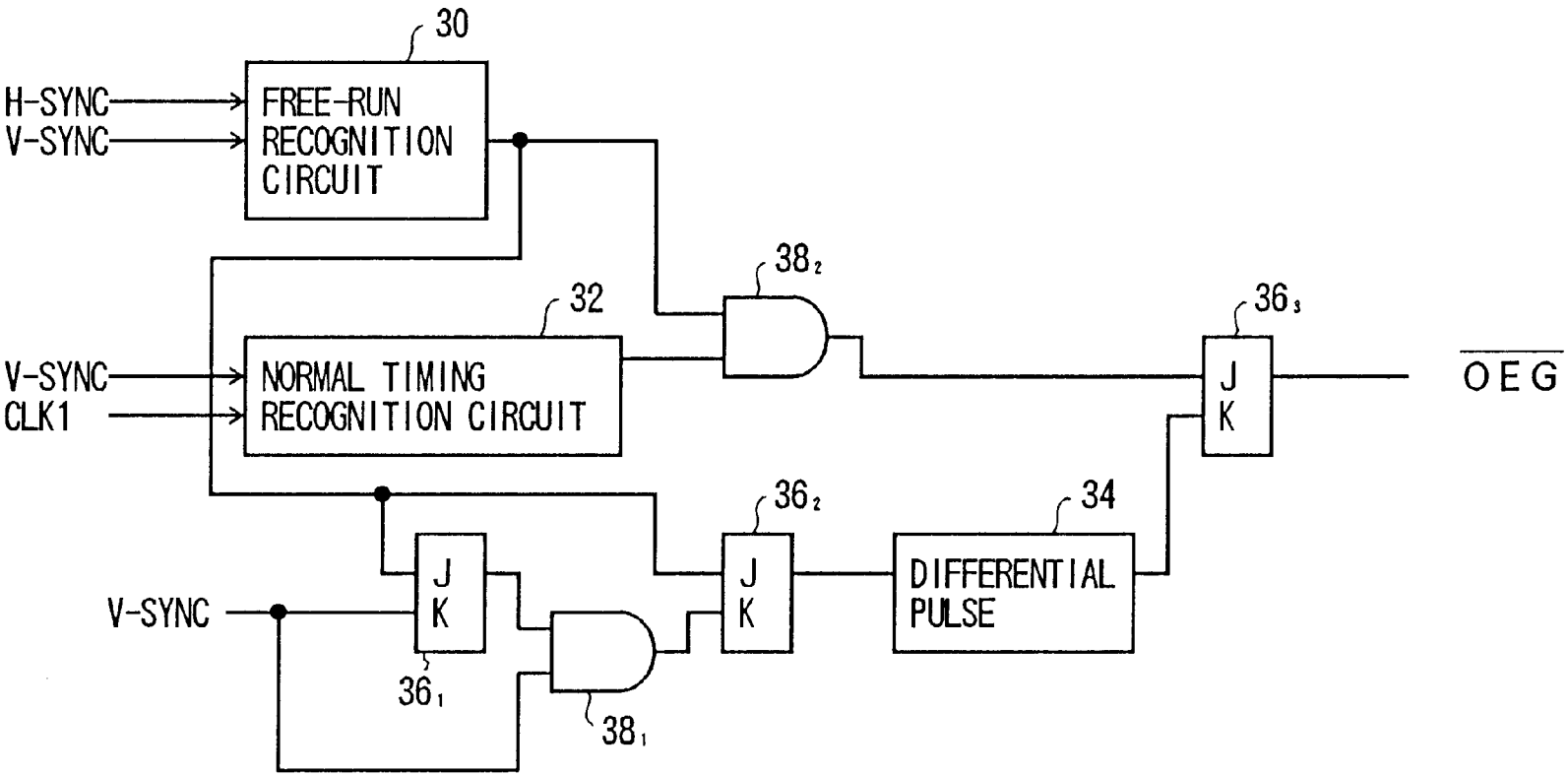
FIG. 6 is a block diagram of a first embodiment of the present invention.

FIG. 6 is a block diagram of a control circuit provided in a matrix-type display driving circuit according to a first embodiment of the present invention. The control circuit shown in FIG. 6 is provided in the timing control circuit 16 shown in FIG. 1. That is, a liquid crystal display device according to the first embodiment of the present invention has the same configuration as shown in FIG. 1 in which the control circuit shown in FIG. 6 is built in the timing control circuit 16. Now, the timing control circuit equipped with the control circuit shown in FIG. 6 is assigned a reference number 160. The control circuit shown in FIG. 6 receives the vertical synchronizing signal V-SYNC, the horizontal synchronizing signal H-SYNC and a sampling clock signal CLK1, and produces the output enable signal /OEG therefrom. The driving circuit for the liquid crystal display device is configured so as to include the timing control circuit 160, the data driver 12 and the gate driver 14.

Figure 4:
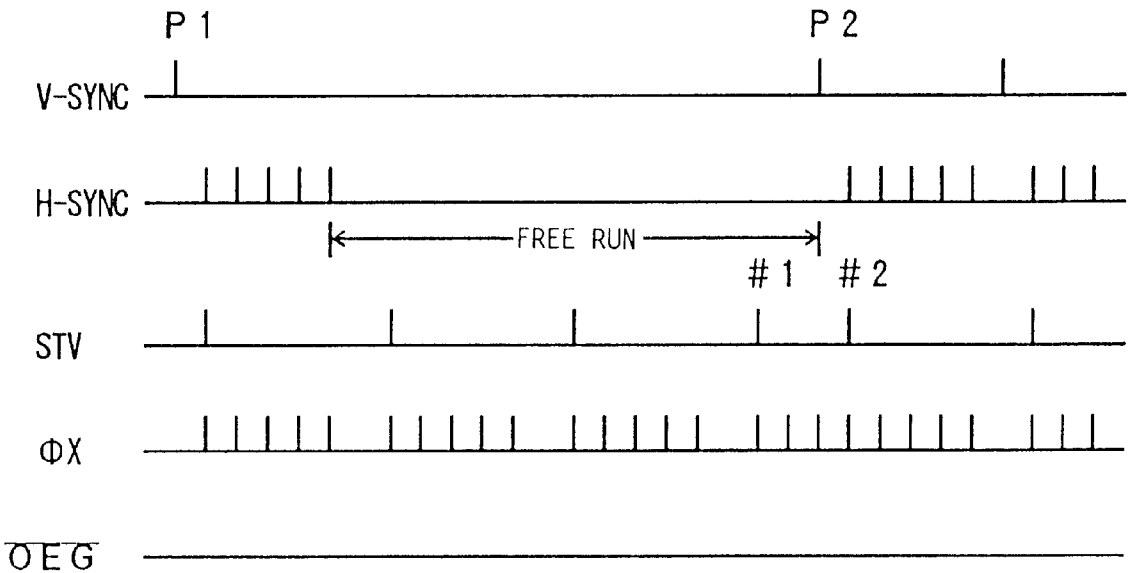
FIG. 4 PRIOR ART
FIG. 4 is a timing chart of an operation of the liquid crystal display device shown in FIG. 1.
Figure 5:
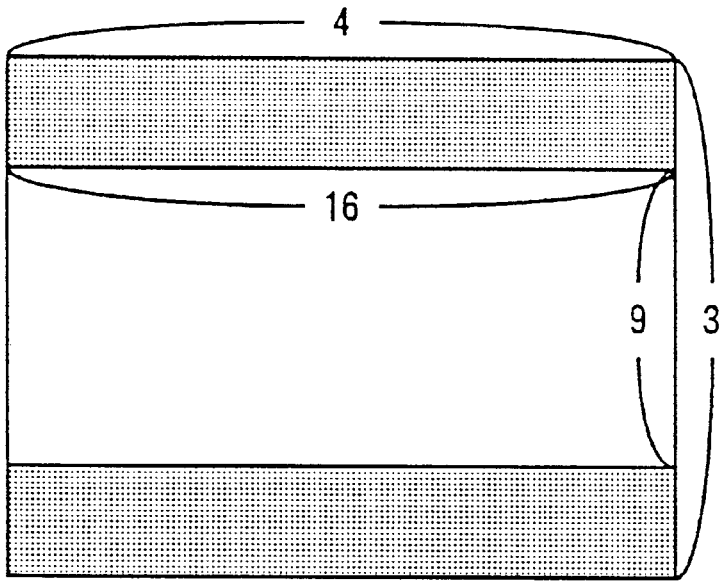
FIG. 5 PRIOR ART
FIG. 5 is a diagram showing an enlarged display.
Figure 7:
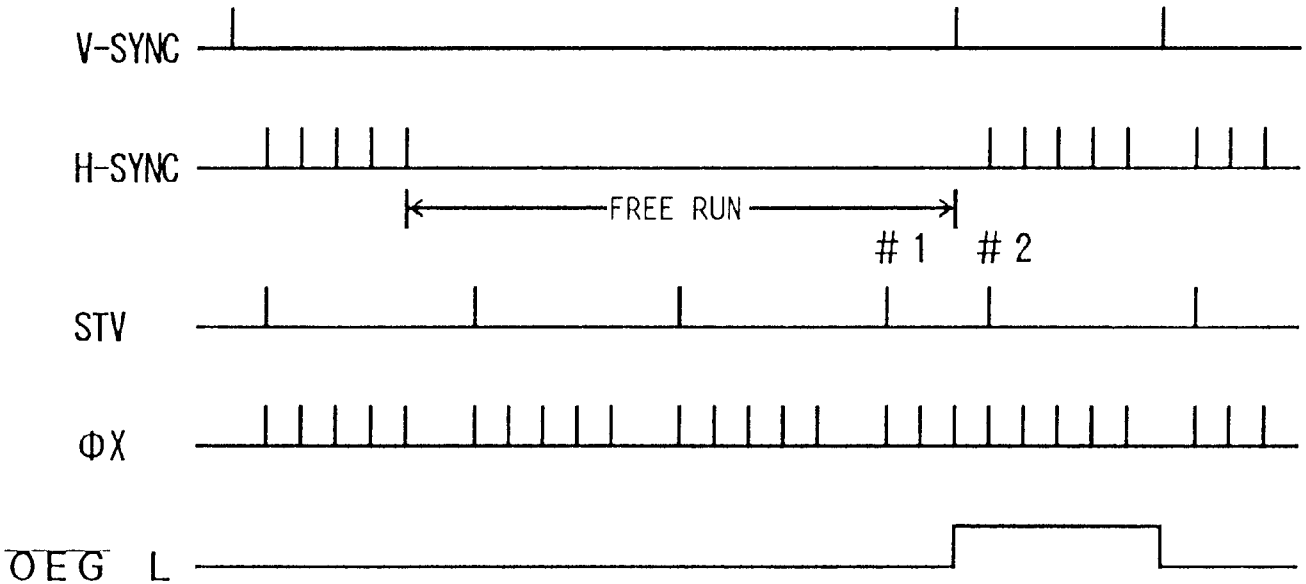
FIG. 7 is a timing chart of an operation of a liquid crystal display device equipped with the circuit configuration shown in FIG. 6.

FIG. 7 is a timing chart of an operation of the timing control circuit 160 equipped with the control circuit shown in FIG. 6. The timing chart shown in FIG. 7 differs from that shown in FIG. 4 as follows. When the timing signals, that is, the synchronizing signals V-SYNC and H-SYNC are input, the output enable signal /OEG is switched to the high level, which prevents data from being written into the panel 10 (disabled state). Then, the output enable signal /OEG is switched to the low level at the second frame of the vertical synchronizing signal V-SYNC and the horizontal timing signal H-SYNC input to the timing control circuit 16, so that writing of data into the panel 10 is started. The RGB data and the gate driver 14 are not synchronized with each other at the first frame of the synchronizing signals V-SYNC and H-SYNC after the supply thereof is restarted. However, the RGB data is synchronized with the vertical synchronizing signal V-SYNC and the horizontal synchronizing signal H-SYNC from the second frame thereof. Hence, the writing of the RGB data is started from the second frame and thus the RGB data can be duly written into the first line of the panel 10. As a result, the disadvantages of the prior art can be eliminated. The RGB data, which is gradation data, may be analog image data or digital image data.

Turning to FIG. 6 again, the control circuit which enables the above control is made up of a free-run recognition circuit 30, a normal timing recognition circuit 32, a differential pulse generating circuit 34, JK flip-flops $\mathbf{36}_1$, $\mathbf{36}_2$ and $\mathbf{36}_3$ and AND gates $\mathbf{38}_1$ and $\mathbf{38}_2$. The free-run recognition circuit 30 detects the free-run state as shown in FIG. 7 from the vertical synchronizing signal V-SYNC and the horizontal synchronizing signal H-SYNC, and outputs a free-run recognition signal to the JK flip-flops $\mathbf{36}_1$ and $\mathbf{36}_2$ and the AND gate $\mathbf{38}_2$. The normal timing recognition circuit 32 counts the pulse duration of the vertical synchronizing signal V-SYNC by the sampling clock CLK1, and determines whether the vertical synchronizing signal V-SYNC is supplied at the normal timing. Then, the normal timing recognition circuit 32 supplies a normal timing recognition signal to the AND gate $\mathbf{38}_2$. The free-run recognition circuit 30 and the normal timing recognition circuit 32 have respective internal structures as will be described later. The sampling clock CLK1 may be externally supplied or generated within the driving circuit.

The JK flip-flop $\mathbf{36}_3$ is set when the free-run recognition circuit 30 recognizes the free-run operation and the normal timing recognition circuit 32 recognizes the normal timing, and the output enable signal /OEG is thus switched to the high level. The JK flip-flops $\mathbf{36}_1$ and $\mathbf{36}_2$ are respectively set by the output signal of the free-run recognition circuit 30. The JK flip-flop $\mathbf{36}_1$ is cleared (reset) by the first frame (pulse) of the vertical synchronizing signal V-SYNC after it is set by the output signal of the free-run recognition signal. The JK flip-flop $\mathbf{36}_2$ is cleared (reset) by the second frame (pulse) of the vertical synchronizing signal V-SYNC. The differential pulse generating circuit 34 generates a pulse signal in response to the falling edge of the output signal of the JK flip-flop $\mathbf{36}_2$, which is thus cleared. Hence, the output enable signal /OEG is switched to the low level.

Figure 8:
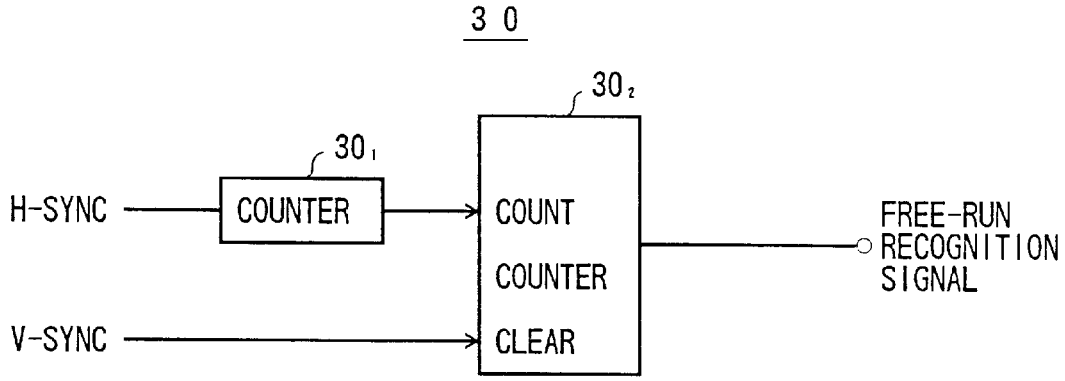
FIG. 8 is a block diagram of a free-run recognition circuit shown in FIG. 6.

FIG. 8 is a block diagram of an internal structure of the free-run recognition circuit 30 shown in FIG. 6. The circuit 30 has counters $\mathbf{30}_1$ and $\mathbf{30}_2$. The RGB data has 262.5 and 312.5 pulses of the horizontal synchronizing signal H-SYNC during one vertical synchronizing period in the NTSC and PAL systems, respectively. The counter $\mathbf{30}_2$ is cleared by the vertical synchronizing signal V-SYNC. If the next pulse of the vertical synchronizing signal V-SYNC is not applied to the counter $\mathbf{30}_2$ when the counter $\mathbf{30}_1$ has counted 263 (NTSC system) pulses of the horizontal synchronizing signal H-SYNC, it is determined that the timing signals, namely, the vertical synchronizing signal V-SYNC and the horizontal synchronizing signal H-SYNC are not supplied. Hence, the counter $\mathbf{30}_2$ outputs the free-run recognition signal.

Figure 9A:
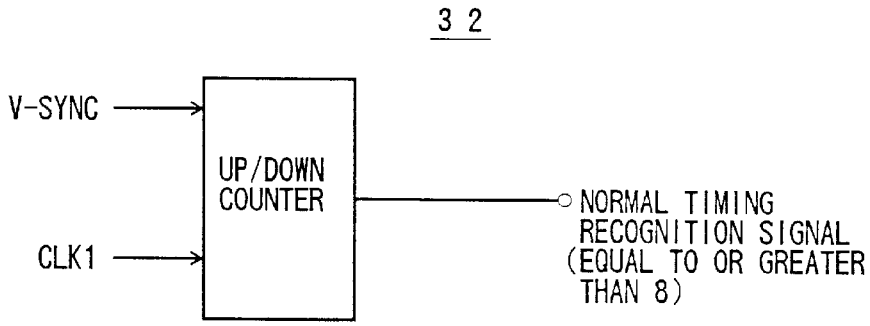
FIG. 9A is a block diagram of a normal timing recognition circuit shown in FIG. 6.
Figure 9B:
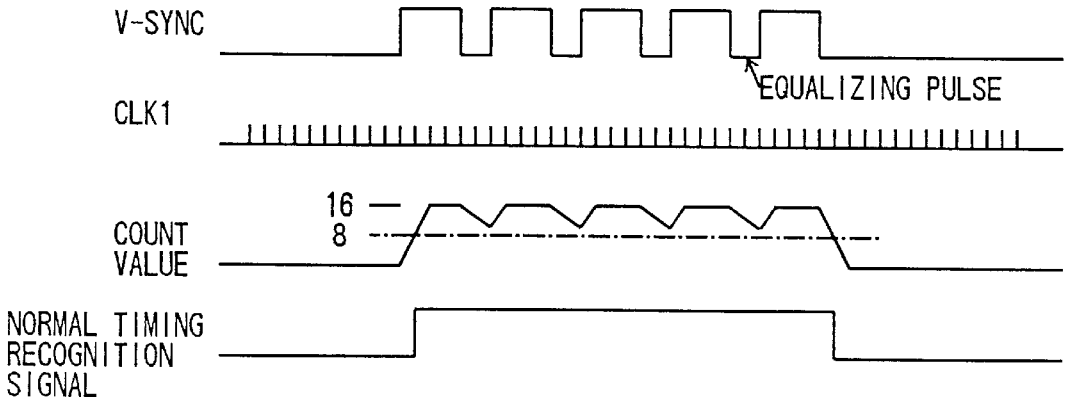
FIG. 9B is a timing chart of an operation of the normal timing recognition circuit.

FIG. 9A is a block diagram of the normal timing recognition circuit 32 shown in FIG. 6. As shown, the circuit 32 is formed of an up/down counter $\mathbf{32}_1$. As shown in FIG. 9B, the vertical synchronizing signal V-SYNC actually has equalizing pulses. Each pulse duration interposed between the equalizing pulses is sampled by the sampling clock CLK1, and the number of count values is integrated. The up/down counter $\mathbf{32}_1$ counts up its count value during the pulse duration and counts down the count value during the equalizing pulse. The up/down counter $\mathbf{32}_1$ has a maximum countable value of, for Example, 16, and a threshold value of, for Example, 8. When the count value is equal to or greater than the threshold value of 8, it is determined that the vertical synchronizing signal V-SYNC is input, so that the up/down counter $\mathbf{32}_1$ outputs the normal timing recognition signal which is a high-level signal.

As described above, the operation shown in FIG. 7 can be realized by generating the output enable signal /OEG from the horizontal synchronizing signal H-SYNC and the vertical synchronizing signal V-SYNC.

Figure 10A:
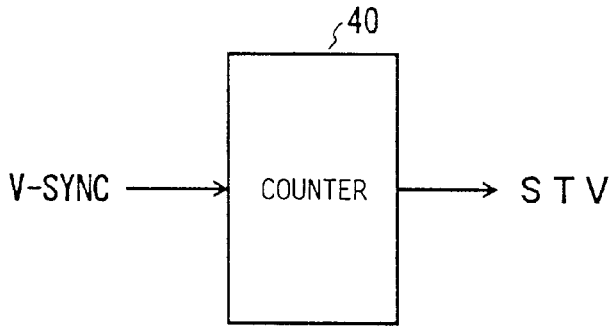
FIGS. 10A and 10B are respectively block diagrams of configurations provided in a timing control circuit of the liquid crystal display device.
Figure 10B:
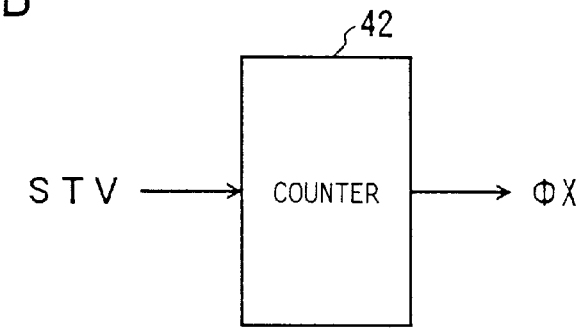

The timing signals STV and Φx applied to the gate driver 14 can be produced by counters 40 and 42 shown in FIGS. 10A and 10B, respectively. The counter 40 shown in FIG. 10A is a periodic counter, which starts the count operation from a given initial value in response to the vertical synchronizing signal V-SYNC and ends the count operation when the count value becomes equal to a predetermined value. In this case, the counter 40 spontaneously restarts the count operation from the initial value. If the next vertical synchronizing signal V-SYNC is applied to the counter 40 which is performing the count operation, the counter 40 restarts the count operation from the initial value. The output signal of the counter 40 is the start pulse signal STV. The counter 42 shown in FIG. 10B receives the start pulse signal STV, and generates a given number of pulses Φx.

Figure 11:
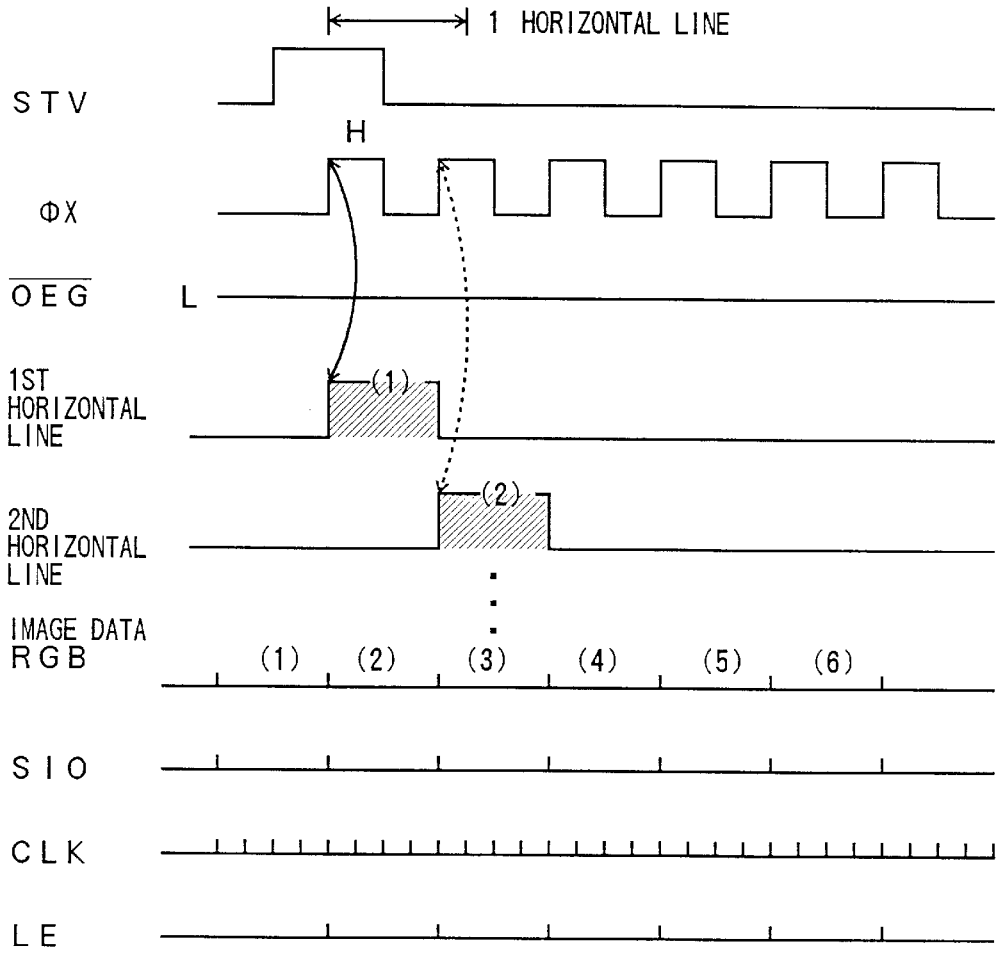
FIG. 11 is a timing chart of an operation of the liquid crystal display device equipped with the configuration shown in FIG. 6.

FIG. 11 is a timing chart of an operation of the liquid crystal display device equipped with the configuration shown in FIG. 6. One horizontal line is selected per one pulse of the shift clock signal Φx, and RGB data applied to the data driver 12 is written into the selected horizontal line at one time in synchronism with the latch control signal LE.

Figure 12:
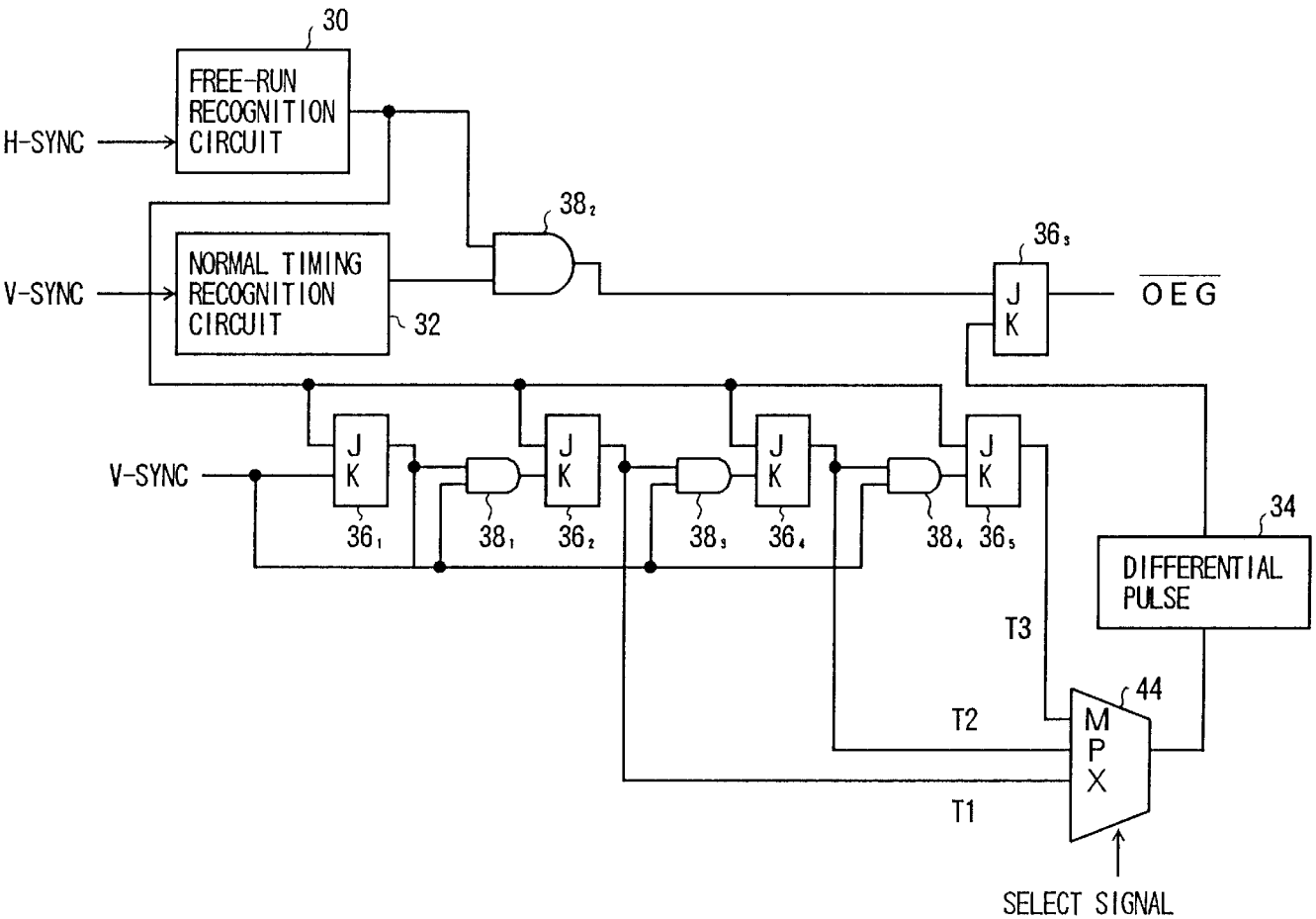
FIG. 12 is a block diagram of a second embodiment of the present invention.
Figure 13:
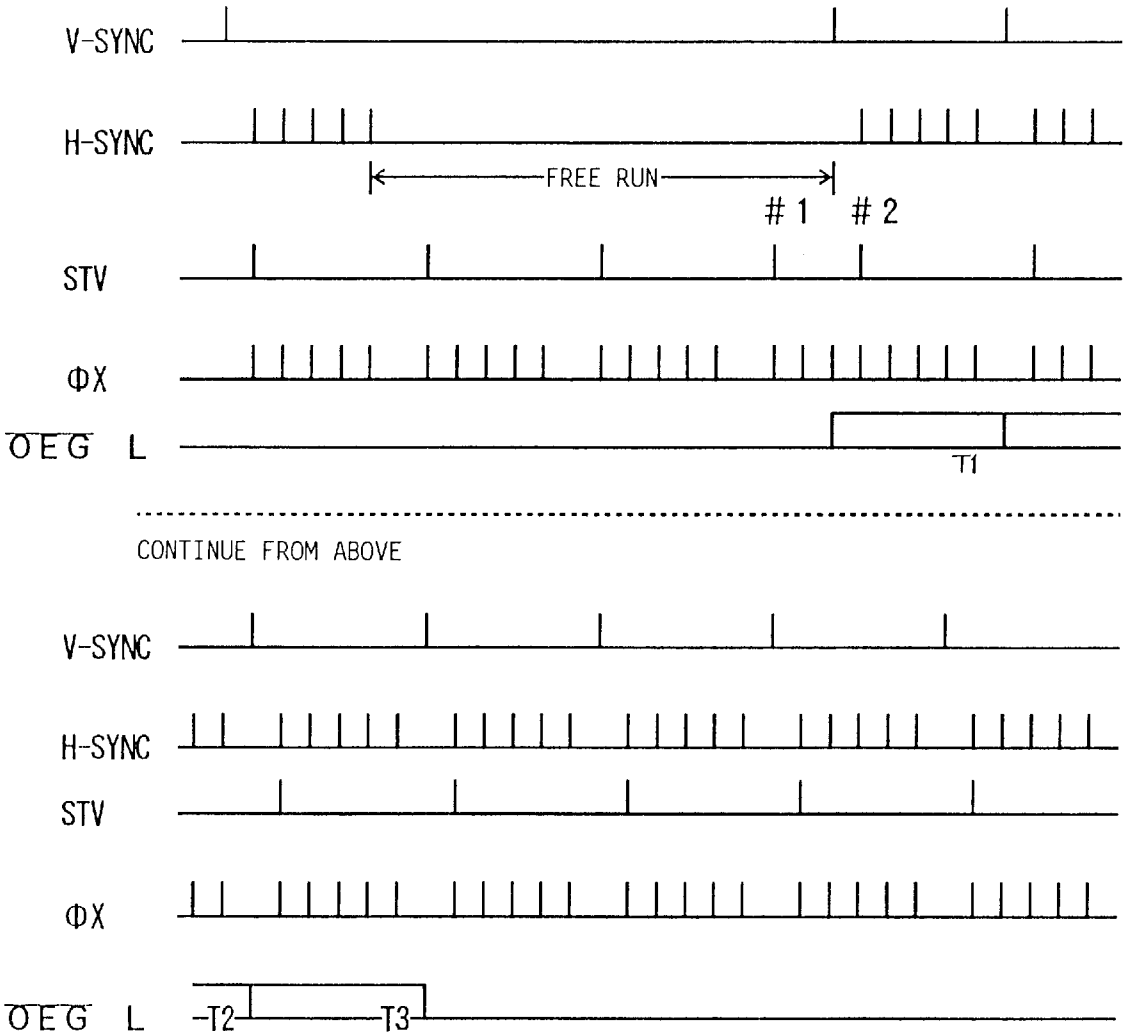
FIG. 13 is a timing chart of an operation of the liquid crystal display device equipped with the configuration shown in FIG. 12.

FIG. 12 is a block diagram of a circuit of the matrix-type panel driving circuit according to a second embodiment of the present invention. In FIG. 12, parts that are the same as those shown in the previously described figures are given the same reference numbers. The control circuit shown in FIG. 12 has an arrangement in which the timing control circuit 160 has a part which generates the output enable signal /OEG. FIG. 13 is a timing chart of the operation of the second embodiment of the present invention.

The second embodiment of the present invention is arranged taking into account a situation in which, even if the vertical synchronizing signal V-SYNC and the horizontal synchronizing signal H-SYNC are applied at the normal timing, there is a source which supplies image data and requires some fields before image becomes duly displayed.

The control circuit shown in FIG. 12 is configured by adding JK flip-flops $\mathbf{36}_4$ and $\mathbf{36}_5$ and a multiplexer (MPX) 44 to the configuration shown FIG. 6. As has been described previously, the output signal of the JK flip-flop $\mathbf{36}_2$ (labeled T1 in FIG. 12) makes the output enable signal /OEG which allows data to be written into the panel 10 from the second frame after the supply of the vertical synchronizing signal V-SYNC is restarted. The output signal T2 of the flip-flop $\mathbf{36}_4$ makes the output enable signal /OEG which allows data to be written into the panel 10 from the third frame after the supply of the vertical synchronizing signal V-SYNC is restarted. The output signal T3 of the flip-flop $\mathbf{36}_5$ makes the output enable signal /OEG which allows data to be written into the panel 10 from the fourth frame after the supply of the vertical synchronizing signal V-SYNC is restarted. The multiplexer 44 functions as a selector, and selects one of the outputs T1, T2 and T3 in accordance with a select signal. The selected signal is then applied to the differential pulse generating circuit 34. The select signal may be supplied externally or generated by means of a switch or the like which is provided in the timing control circuit 160. As shown in FIG. 13, the high-level duration of the output enable signal /OEG depends on the signal selected from among the signals T1, T2 and T3.

It can be seen from FIG. 13 that the present control circuit can adjust the timing at which the writing of data into the panel 10 is restarted.

It is possible to further provide a JK flip-flop and an AND gate in order to write data into the panel 10 from the fifth frame or later.

Figure 14:
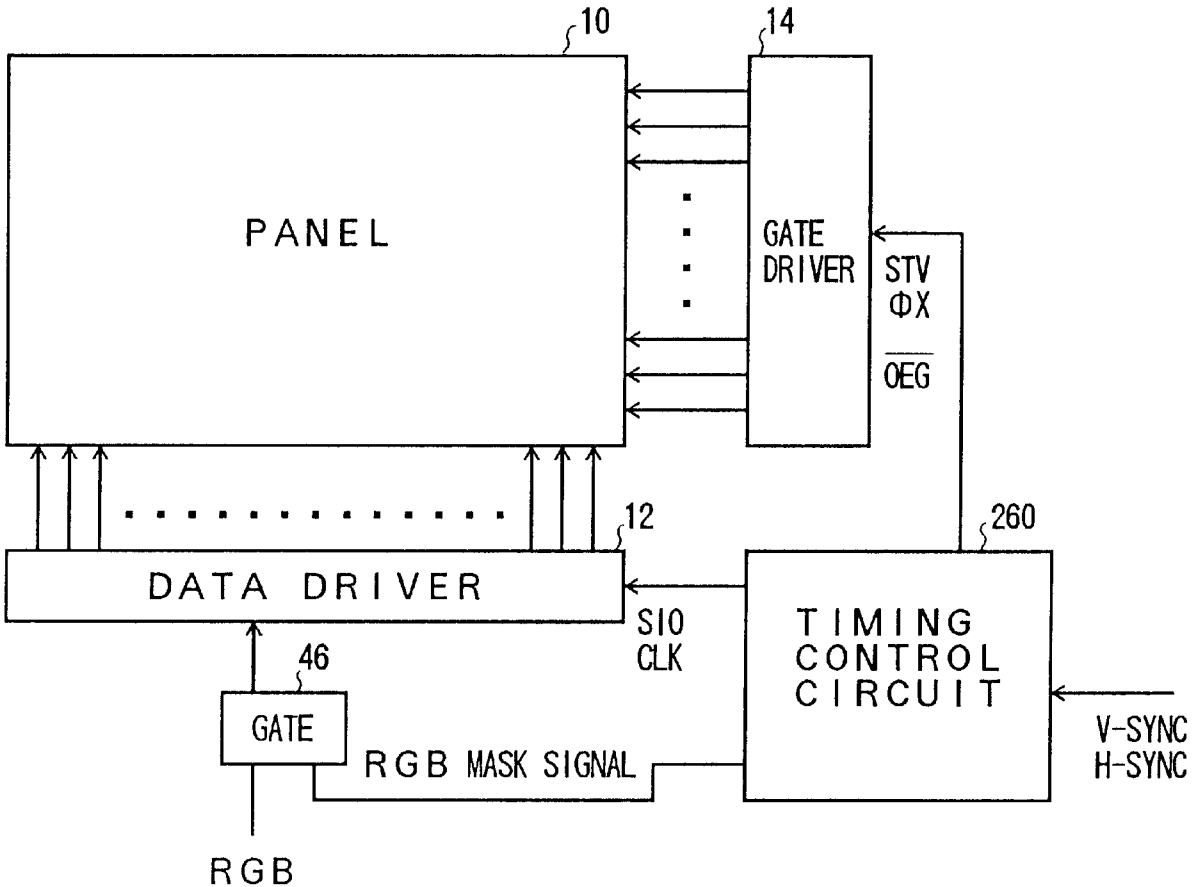
FIG. 14 is a block diagram of a liquid crystal display device according to a third embodiment of the present invention.

A description will now be given of a third embodiment of the present invention by referring to FIG. 14, which is a block diagram of a liquid crystal display device equipped with a driving circuit according to a third embodiment of the present invention. In FIG. 14, parts that are the same as those shown in the previously described figures are given the same reference numbers. The aforementioned first and second embodiments of the present invention are directed to controlling the output enable signal /OEG applied to the gate driver 14. The third embodiment of the present invention is directed to masking the externally supplied RGB data during a given period after the supply of the vertical synchronizing signal V-SYNC is restarted from the free-run state, so that the RGB data can be prevented from being applied to the data driver 12 during the given period. A timing control circuit 260 shown in FIG. 14 generates an RGB mask signal which indicates the above given period for masking, and supplies it to a gate circuit 46. During the masking period, the panel 10 is made to display a predetermined fixed color such as blue or white rather than supply the image data externally supplied.

Figure 15A:
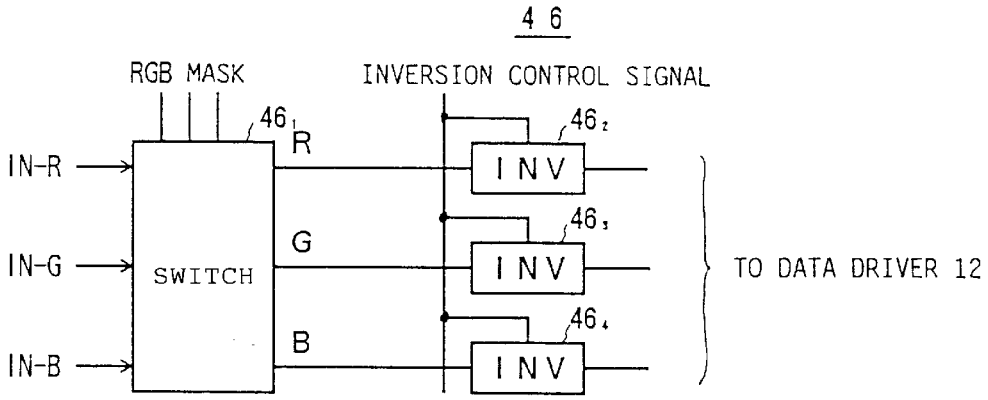
FIGS. 15A, 15B and 15C are diagrams of parts of a gate circuit shown in FIG. 14.
Figure 15B:
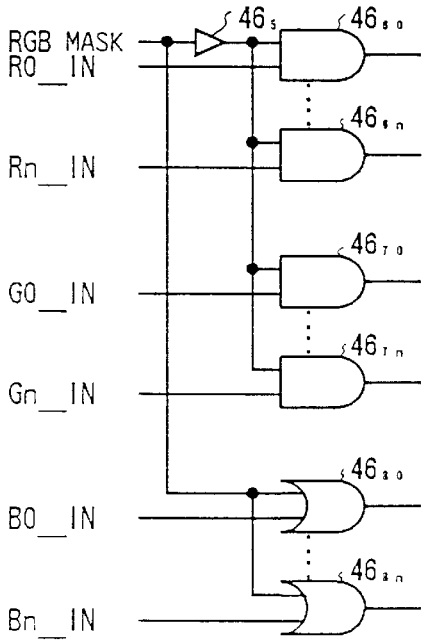
Figure 15C:
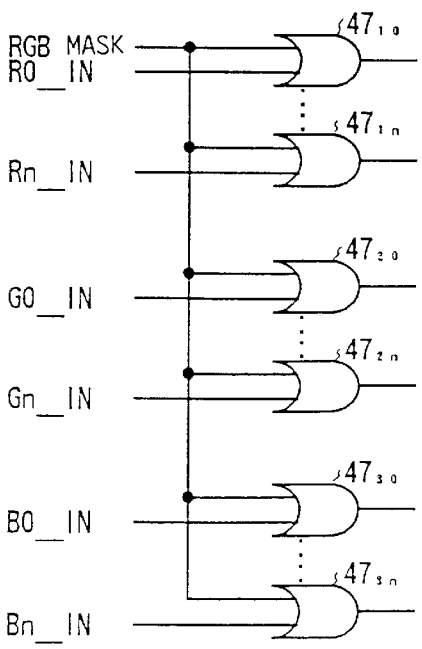

FIGS. 15A, 15B and 15C are respectively block diagrams of structures of the gate circuit 46 shown in FIG. 14. The structure of FIG. 15A handles RGB data which is analog image data, while the structures of FIGS. 15B and 15C handle RGB data which is digital image data.

Referring to FIG. 15A, the gate circuit 46 is made up of a switch $\mathbf{46}_1$ and inverters $\mathbf{46}_2$, $\mathbf{46}_3$ and $\mathbf{46}_4$. The switch $\mathbf{46}_1$ receives mask signals respectively defined for R, G and B from the timing control signal 260 and externally receives image signals IN-R, IN-G and IN-B. The switch $\mathbf{46}_1$ selects a display based on image data or a display of a single color based on the RGB mask. The ac driving is carried out by the inverters $\mathbf{46}_2$, $\mathbf{46}_3$ and $\mathbf{46}_4$ which operate an inversion control signal supplied from the timing control circuit 260. For example, when blue is displayed, only the mask signal for B is selected and applied to the switch $\mathbf{46}_1$. Then, the switch $\mathbf{46}_1$ sets the B signal to the low level and sets the R and G signals to the high level.

The gate circuit 46 shown in FIG. 15B processes R, G and B digital signals, each consisting of a plurality of bits, and includes AND gates $\mathbf{46}_{60}$–$\mathbf{46}_{6n}$ and $\mathbf{46}_{70}$–$\mathbf{46}_{7n}$ and OR gates $\mathbf{46}_{80}$–$\mathbf{46}_{8n}$. With the above configuration, the gate circuit 46 realizes a display of blue at the time of masking. When blue is displayed, data B0_IN to Bn_IN are masked by the OR gates $\mathbf{46}_{80}$–$\mathbf{46}_{8n}$ which receives the RGB mask signal. The AND gates $\mathbf{46}_{60}$–$\mathbf{46}_{6n}$ perform respective AND operations on data R0_IN–Rn_IN and the inverted version of the RGB mask signal output by an inverter $\mathbf{46}_5$. Similarly, the AND gates $\mathbf{46}_{70}$–$\mathbf{46}_{7n}$ perform respective AND operations on data G0_IN–Gn_IN and the inverted version of the RGB mask signal output by the inverter $\mathbf{46}_5$. The gate outputs are as follows: B0–Bn=1, R0 –Rn=G0–Gn=0. Hence, blue is displayed.

The configuration of the gate 46 shown in FIG. 15C is directed to displaying while at the time of masking, and includes OR gates $\mathbf{47}_{10}$–$\mathbf{47}_{1n}$, $\mathbf{47}_{20}$–$\mathbf{47}_{2n}$ and $\mathbf{47}_{30}$–$\mathbf{47}_{3n}$. The RGB mask signal causes all the gate outputs to the high level, and white is thus displayed.

Figure 16:
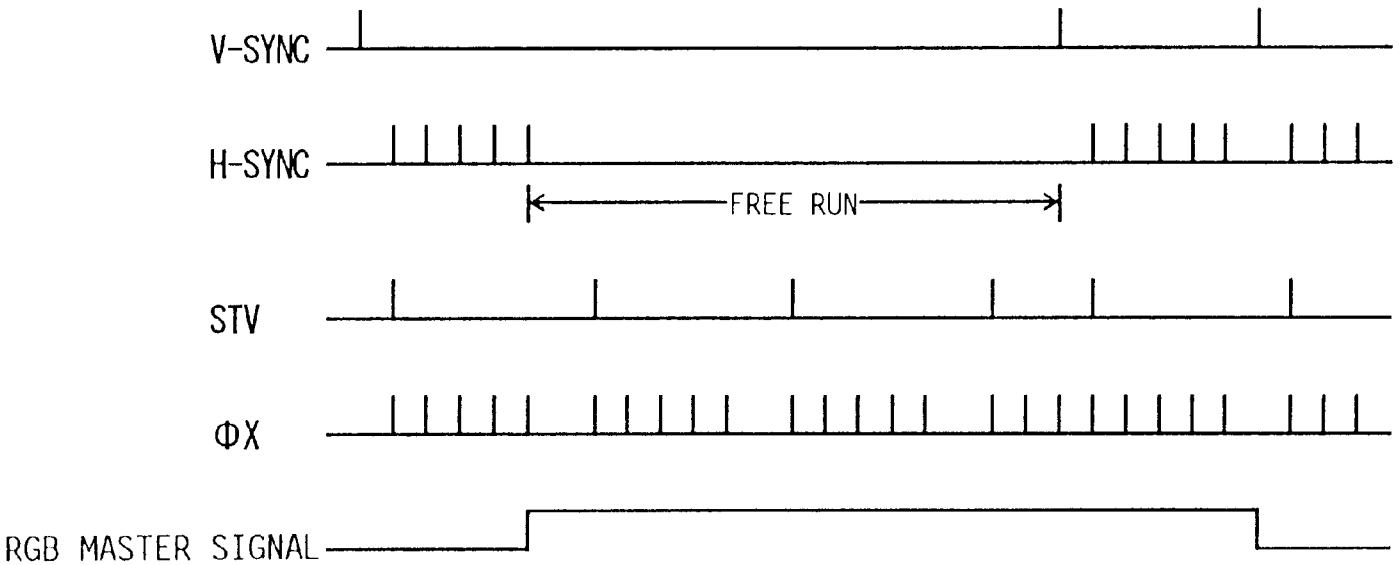
FIG. 16 is a timing chart of an operation of the liquid crystal display device shown in FIG. 14.

FIG. 16 is a timing chart showing a relationship between the RGB mask signal and other signals. The RGB mask signal is maintained at the high level from the time when the free-run state occurs to a given time after the end of the free-run state. In FIG. 16, the above given time is equal to one frame. The RGB data is supplied to the panel at the time when the synchronization between the first horizontal line of the RGB data and the first line of the panel 10 is established.

Figure 17:
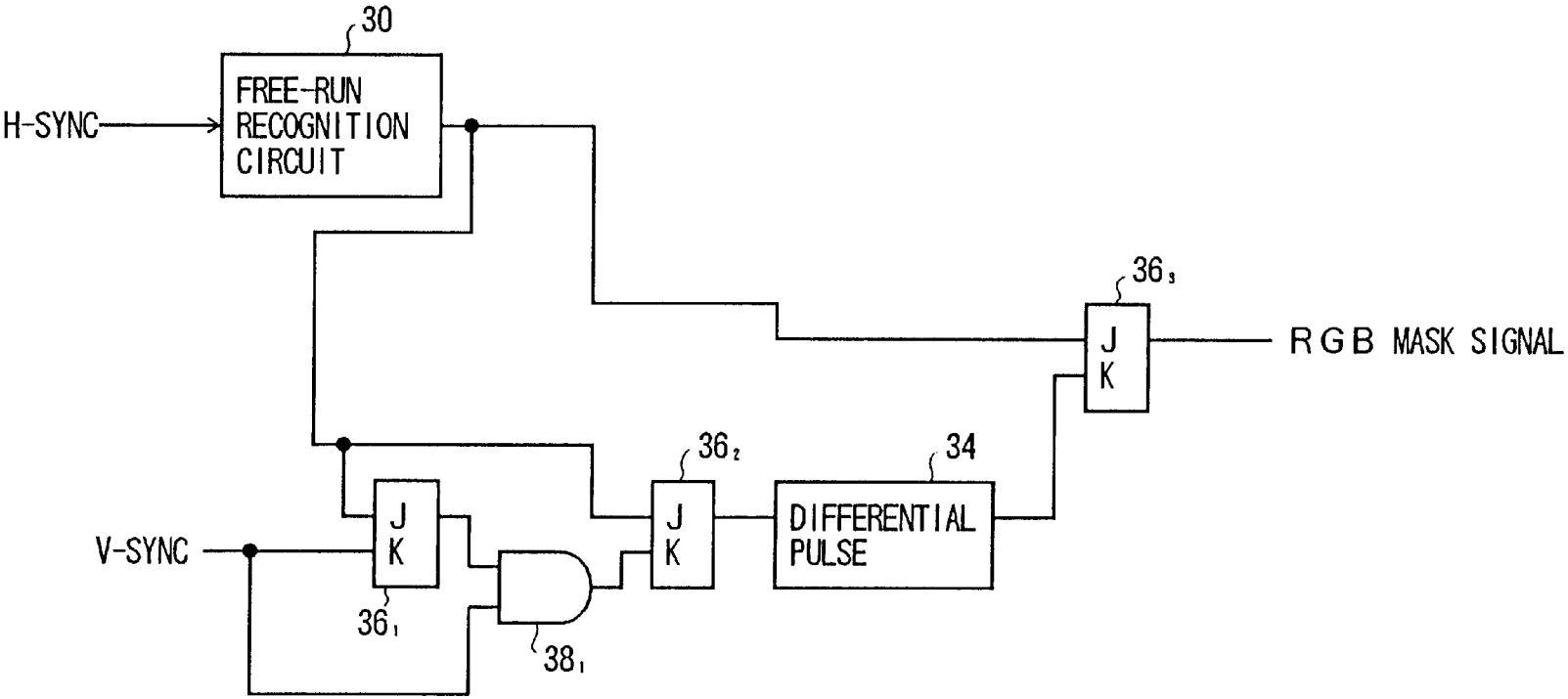
FIG. 17 is a block diagram of a structure of the timing generating circuit of the liquid crystal display device shown in FIG. 14.

FIG. 17 is a block diagram of a circuit configuration which generates the RGB mask signal. The circuit shown in FIG. 17 is provided in the timing control circuit 260. In FIG. 17, parts that are the same as those shown in the previously described figures are given the same reference numbers. The circuit configuration shown in FIG. 17 is equivalent to that obtained by omitting the normal timing recognition circuit 32 from the configuration shown in FIG. 6. The output signal of the free-run recognition circuit 30 is directly applied to the JK flip-flop $\mathbf{36}_3$. The JK flip-flop $\mathbf{36}_3$ is set when the free-run state is recognized, and is cleared at the second frame after the supply of the vertical synchronizing signal V-SYNC is restarted.

The circuit which generates the RGB mask signal is not limited to the circuit shown in FIG. 17. For example, as shown in FIG. 12, the JK flip-flops $\mathbf{36}_4$ and $\mathbf{36}_5$ and the AND gates $\mathbf{38}_3$ and $\mathbf{38}_4$ shown in FIG. 12 are added to the circuit configuration shown in FIG. 17. Hence, it is possible to mask the period equal to at least two frames after the supply of the vertical synchronizing signal V-SYNC is restarted.

The present invention is not limited to the specifically disclosed embodiments, and variations and modifications may be made without departing from the scope of the present invention. For example, the present invention is not limited to the liquid crystal display device and includes matrix-type devices of other types.

What is claimed is:

1. A control circuit for a driving circuit of a matrix-type panel comprising:

a detection circuit that detects an input of a given timing signal and performs control according to a detected result;

a data driver which latches image data equal to one horizontal line of the matrix-type panel and outputs the image data thereto;

a gate driver which sequentially selects one of horizontal lines of the matrix-type panel in order to write the image data to a selected horizontal line; and a circuit which causes an output of the gate driver to be in a disabled state during a given period after a supply of the given timing signal is stopped and is then restarted.

2. The driving circuit as claimed in claim 1, further comprising a circuit which varies the given period.

3. The driving circuit as claimed in claim 1, wherein said control circuit comprises:

a data driver which latches image data equal to one horizontal line of the matrix-type panel and outputs the image data thereto;

a gate driver which sequentially selects one of horizontal lines of the matrix-type panel in order to write the image data to a selected horizontal line; and a circuit which supplies a given value to the data driver instead of the image data during a given period after the supply of the given timing signal is stopped and is then restarted.

4. A driving method for a matrix-type panel comprising the step of causing image data to be supplied to the matrix-type panel when a synchronization between the image data and an operation of the matrix-type panel is established after a supply of a control circuit enabling signal is stopped and is then restarted.

5. The driving method as claimed in claim 4, further comprising the steps of:

latching image data equal to one horizontal line of the matrix-type panel and outputting the image data thereto;

sequentially selecting one of horizontal lines of the matrix-type panel in order to write the image data to a selected horizontal line; and causing the outputting of the image data to be in a disabled state for a finite durational period after the supply of the enabling signal is stopped and is then restarted.

6. The driving method as claimed in claim 4, further comprising the steps of:

latching image data equal to one horizontal line of the matrix-type panel and outputting the image data thereto;

sequentially selecting one of horizontal lines of the matrix-type panel in order to write the image data to a selected horizontal line; and supplying a given value to the matrix-type panel instead of the image data during a given period after the supply of the given timing signal is stopped and is then restarted.

7. A matrix-type display device comprising:

a matrix-type panel; and a driving circuit driving the matrix-type panel and including a control circuit, wherein said control circuit comprises:

a data driver which latches image data equal to one horizontal line of the matrix-type panel and outputs the image data thereto;

a gate driver which sequentially selects one of horizontal lines of the matrix-type panel in order to write the image data to a selected horizontal line; and a circuit which causes an output of the gate driver to be in a disabled state during a given period after a supply of a given timing signal is stopped and is then restarted.

8. The matrix-type display device as claimed in claim 7, further comprising a circuit which varies the given period.

9. The matrix-type display device as claimed in claim 7, wherein said control circuit comprises:

a data driver which latches image data equal to one horizontal line of the matrix-type panel and outputs the image data thereto;

a gate driver which sequentially selects one of horizontal lines of the matrix-type panel in order to write the image data to a selected horizontal line; and a circuit which supplies a given value to the data driver instead of the image data during a given period after the supply of the given timing signal is stopped and is then restarted.

* * * * *